United States Patent [19]

Baughman

[11] Patent Number: 4,625,889

[45] Date of Patent: Dec. 2, 1986

[54] REPLACEABLE, CRIMP-ON, THREADED CLOSURE FOR PLASTIC CONTAINER

[75] Inventor: Gary M. Baughman, Auburn, Ind.

[73] Assignee: Rieke Corporation, Auburn, Ind.

[21] Appl. No.: 789,510

[22] Filed: Oct. 21, 1985

[51] Int. Cl.[4] ..... B65D 17/00

[52] U.S. Cl. ..... 220/288; 428/35; 29/453

[58] Field of Search ..... 220/239, 288; 29/453

[56] References Cited

U.S. PATENT DOCUMENTS

| | | | |
|---|---|---|---|
| 2,842,282 | 7/1958 | Parish, Jr. et al. | 220/39 |
| 3,098,579 | 7/1963 | Wheaton | 220/39 |
| 3,179,280 | 4/1965 | Littlefield | 220/27 |
| 3,437,226 | 4/1969 | Helwig | 220/39 |
| 3,684,125 | 8/1972 | Laurizio | 220/27 |
| 3,747,962 | 7/1973 | Bauman | 285/202 |
| 3,940,845 | 3/1976 | Czerwiak | 29/453 |
| 3,958,719 | 5/1976 | Ward | 220/288 |
| 4,114,779 | 9/1978 | Stoll, III | 220/288 |
| 4,195,750 | 4/1980 | Fee | 220/288 |

*Primary Examiner*—John E. Kittle
*Assistant Examiner*—Patrick J. Ryan
*Attorney, Agent, or Firm*—Woodard, Weikart, Emhardt & Naughton

[57] ABSTRACT

A plastic drum and closure assembly for providing a replaceable two-inch straight pipe thread flange includes a synthetic material drum having a drum end which is molded with a two-inch buttress thread opening and an internally splined raised annular boss which is suitably designed and arranged to receive an externally splined plastic flange member which includes an internal series of two-inch straight pipe threads. The flange is secured to the raised annular boss by means of a metal retaining ring which is shaped and conforms to the outer lip portion of the flange thereby providing an outwardly-deformable surface and an inner back-up surface. Installation of the flange into the raised annular boss begins with the alignment of the internal and external splines and once the flange is fully seated within the raised annular boss the metal retaining ring is crimped so as to conform the outwardly radiating lip portion of the flange to the lip portion of the raised annular boss thereby providing a liquid-tight interface between the two members. The style of the retaining ring and the shape and contour of the raised annular boss permit the plastic flange to be removed, once damaged, and a replacement flange to be installed and reassembled.

11 Claims, 5 Drawing Figures

REPLACEABLE, CRIMP-ON, THREADED CLOSURE FOR PLASTIC CONTAINER

BACKGROUND OF THE INVENTION

The present invention relates in general to threaded closures for drums and similar containers. More particularly, the present invention relates to a replaceable, threaded closure for plastic drums wherein the closure is crimped to the drum neck and a removable plug closes the central opening of the closure. The closure is designed to be replaced such that the drum filler on reconditioner is able to replace the closure when the threads become damaged.

Plastic drums of the type with which the present invention closure will be used generally include a two-inch, buttress-threaded opening and a two-inch straight (standard) pipe-threaded opening. From a strength and reliability standpoint, the butress-thread opening is preferred for plastic drums. With such an opening, it is relatively simple to overcome cold flow and other characteristics of plastics in order to provide an opening/-closure combination which seals easily and passes the required drop and hydrostatic pressure tests.

The presence of a two-inch straight pipe thread opening as one of the two drum openings presents a different set of concerns from those of the buttress-thread opening. The cold flow characteristics of plastics and the ease with which plastics expand and contract during cooling after processing creates a number of problems for container and closure fabricators. Concerns over tolerance variations, shrink and warpage must all be addressed when plastics are used for the drum and the drum openings. Another concern with the use of a two-inch straight pipe thread is that after it is molded, it is not as strong as the buttress thread opening simply because there is not the same mass of plastic present in the individual threads.

A further concern with the use of plastic for the two-inch straight pipe thread opening is that it is relatively easy for the end user of the container to cross thread a metal pump or valve into the two-inch opening and as a result ruin the entire drum as far any any refilling or redistribution is concerned. One possible solution to this problem is to put two buttress-thread openings in the drum, in essence replacing the two-inch straight pipe thread with an additional buttress thread. However, this revision, while possible, is generally regarded as being unacceptable because there is very little buttress-threaded dispensing equipment in the field. Consequently, while the two openings are needed for filling and dispensing, wherein one of the two openings serves as a vent, the thread styles of these two openings must take into consideration field use. Since the dispensing equipment in the field normally incorporates a two-inch straight pipe thread, that thread style must be provided as part of one of the two drum end openings.

The present invention allows the drum filler as well as the reconditioner to replace the closure which provides the two-inch straight pipe threads once those threads become damaged. The drum filler or reconditioner simply removes the closure with a special removal tool and then crimps on a new closure with a suitable crimping tool.

While the closure art is quite crowded, the types of closures can generally be classified as to their features and/or applications. Considering one such classification as including closures which are internally threaded, crimped to a drum neck opening and which use a removable plug for closing the central opening of the closure, the following references are believed to be of interest as a sampling of what is known in the art in this particular classification.

| Pat. No. | Patentee |
|---|---|
| 3,179,280 | Littlefield |
| 4,114,779 | Stoll, III |
| 3,684,125 | Laurizio |
| 3,958,719 | Ward |
| 3,747,962 | Bauman |
| 4,195,750 | Fee |
| 3,098,579 | Wheaton |
| 3,080,182 | Waldo |
| 2,842,282 | Parish |
| 3,437,226 | Helwig |

Littlefield discloses a closure for containers wherein an internally threaded plastic closure is secured to the raised metal boss of a drum end opening by means of a crimping ring. To the extent that this reference discloses a plastic closure secured to a drum end, it is relevant. However, the fact that the crimping ring is disposed within the plastic closure and is actually deformed and crimped into and against the raised metal boss of the drum end results in this particular closure being nonremovable in a manner that would allow a new closure to be installed by the filler or reconditioner. The crimping procedure disclosed in Littlefield actually deforms the neck finish of the drum end thereby precluding a repeat of the assembly process.

Stoll, III discloses a closure assembly for plastic drums wherein a tubular projection of the drum head is formed with buttress threads and the closure includes an adapter having external buttress threads for engagement with tubular projection and internal standard pipe threads in order to receive standard pipe threaded members such as dispensing valves, pump fittings, as well as standard bung plugs. The particular design disclosed in Stoll does not include a retaining ring which secures the closure into the drum end. As a result the structure disclosed by Stoll is not believed to provide the necessary strength and durability required for retention of the closure in its desired location and orientation. An additional concern with this type of design is that there is now one additional interface through which contents of the drum may leak. One benefit of having a crimped-on outer retaining ring which conforms a portion of the internally threaded flange to the neck finish is that there is provided a liquid-tight interface. That particular interface is not provided by the design of Stoll.

Laurizio discloses a container closure assembly which includes a synthetic plastic closure flange, a closure plug and an overlying synthetic plastic cap seal which includes a metal securing ring. In Laurizio, the retaining ring is joined to the outer portion of the overseal, and while it is used to crimp the overseal against the internally threaded plastic flange, there appears to be very little crimping strength provided inasmuch as the metal retaining ring does not extend axially on both sides of the raised neck finish of the drum end. Consequently, any crimping force must be controlled so as not to distort or break any portions of the plastic flange or neck finish. In the present invention, the retaining ring used is of a wrap-around design such that it provides a suitable back-up support for the crimping operation such that the outer, radially extending lip of the internally threaded plastic closure can be tightly crimped to the neck finish without risking any distortion or damage to the remainder of the closure. Another aspect of the present invention is the presence of internal splines as part of the neck finish and cooperating external splines on the outside diameter surface of the internally threaded plastic flange. The mating engagement of these internal and external splines strengthens the overall closure against movement under torque and rotation as threaded members may be inserted and removed during filling and dispensing operation.

The structure of Laurizio does not disclose such splines and the general impression formed is of a low-strength closure wherein the plastic flange merely snaps over an enlarged head portion of the neck finish of the drum end and thereafter the retaining ring is lightly crimped in order to hold the snap fit together. This snap-fit concept and the fact that the flange of Laurizio is not actually crimped around the neck finish is evident from the matching shapes of neck finish 3 and the receiving recess of sealing portion 9.

Ward discloses a container for fluids which includes a cap and a coupling member which is interposed between the neck of the container and the cap which is fitted to the container after it has been formed. The coupling member is readily attachable to the container from its exterior without requiring any modification to the container or other components. This particular design is generally a snap-in type of fit not involving either a splined neck finish nor a metal crimping ring. The particular design is not believed to be designed for use with plastic drums, nor does it appear to have the requisite strength and resistance to torque which would be necessary for receiving and functioning properly with various filling and dispensing equipment which must be threadedly received by the internal threads of the closure.

Bauman, Fee and Parish while arguably somewhat relevant to the present invention, possess one characteristic which makes their design completely unacceptable as a means of complying with the teachings of the present invention. Each of these three designs require insertion of and assembly of the plastic closure from inside of the drum, moving from the inside to the outside. In order to make these types of closure assemblies, it is necessary that the closure be assembled to the drum end prior to completing the fabrication of the drum. Consequently, although each of these references do disclose some type of closure which is secured to a neck finish of a drum end, the particular geometry of each plastic closure necessitates that it be inserted from the inside of the container in an outward direction. This is only possible prior to fabrication of the container and would thus not be an acceptable design for a closure which is designed for and intended to be replaced by fillers and reconditioners. As used herein, the term "filler" means the customer for the container manufacturer, and the term "reconditioner" is one who purchases used containers and sells these back to the fillers.

Wheaton discloses a closure design which is intended for restoring drums (steel barrels) to a leak-proof condition once its particular gaskets have been rendered ineffective by the heat employed in the reconditioning of steel drums. However, the Wheaton design does nothing to restore the thread condition, it is only directed to the gasket/sealing problem. This particular design also fits within the same category of Bauman, Fee and Parish wherein the closure must be inserted through the drum end, from inside of the drum in an outward direction. After such insertion, the top margin of the closure is beaded over the neck of the drum end (6). The particular invention of Wheaton is directed to the addition of auxiliary gaskets in order to reestablish a leak-proof condition once that condition has deteriorated. Again, as with the foregoing group of references, the plastic closure is not designed as a replaceable unit, which is in fact the primary purpose of the present invention.

Waldo discloses a container closure wherein an annular slot is provided in the undersurface of the closure and is designed and arranged to fit over a generally cylindrical raised wall formed in the drum end. An externally threaded plug is used to close the central opening in the closure flange and a cap seal is crimped in place covering both the plug and the closure flange as a final securing and sealing means for storage and shipment. Based upon the design of the disclosed flange and the shape and style of the drum neck finish, it is clear that this particular structure is not suitable for a drum opening which will be subjected to high levels of torque in the installing and removing of various threaded fittings for the filling and dispensing of the container contents. Additionally, the neck finish is straight and cylindrical and the closure flange actually rises above the drum end rather than being received down inside of the drum end. There is thus some question as to this raised height and its suitability for shipment and storage, wherein the present invention provides a much lower profile configuration.

Helwig discloses a plastic closure flange assembly which is attached to a raised metal boss of a drum end by means of an annular retaining ring which is actually received by the plastic closure. This particular design concept is not intended to provide a removable/replaceable flange. Rather, the flange assembly of Helwig is to be permanently secured to the above-described opening formation by placing the flange seal lip thereover and forming the securing ring leg 23 radially inwardly adjacent its lower edge so as to pinch the lowermost end 14 of the lip outer wall 13 against the free edge 54 and cause the plastic material to be squeezed therebetween as shown (column 3, lines 11–18). In order to achieve the desired degree of securement and the compression of the plastic material against extending portion 53, that portion is deformed during the crimping operation. Thus, even if it was possible to remove the plastic closure from the drum neck finish, replacement and reassembly of a new closure member would be quite difficult since the available degree of tightening and compression, and the actual deformation of portion 53 will have previously occurred, it will be difficult, if not impossible, to reestablish the requisite seal at that component interface. With the present invention, there is no deformation nor any distortion of the drum end neck finish.

In fact, one characteristic of a plastic drum as opposed to a metal drum is the wall thickness which is present and the ability to mold the drum material into various shapes and contours. By providing a drum end neck finish with substantial wall thickness, that particular portion of the drum end can be made very durable and unyielding. Since the outer lip of the flange of the present invention, which is crimped around the neck finish, is of a thinner cross-sectional dimension than the neck finish, it is thus more deformable. Finally, as is taught by the present invention, by shaping the retaining ring such that it extends on both sides of the neck finish, very tight and secure crimping is possible without deforming or altering any other portion of the closure and without affecting nor altering the neck finish such that its shape remains constant. By allowing that neck finish shape to remain unaffected, it is always available in the same location and with the same contour for the assembly thereto of replacement closures.

Although several of the listed patent references which have been discussed above disclose closures which include a crimping ring, a closing plug and an internally threaded opening, the present invention provides a unique design which is specifically styled for replacement of the closure. The particular shape and contour of the component parts of the present invention enable removal of the closure while still preserving the drum and its neck finish appearance thereby permitting new closures to be installed and recycling of the drum even though the original closure threads may be damaged.

SUMMARY OF THE INVENTION

A plastic drum and closure combination for providing a replaceable threaded opening according to one embodiment of the present invention comprises a synthetic material drum having a drum end molded with a two-inch buttress thread opening and an internally splined, raised annular boss and a two-inch straight pipe thread closure comprising an externally splined flange member of synthetic material and unitary construction and having internal threading and an outwardly radiating lip which is suitably designed and arranged to receive the raised annular boss, an annular metal retaining ring shaped to conform to the outer surface of the outwardly radiating lip, a unitary, synthetic material closure plug having a series of external threads which are designed and arranged for engagement with the internal threading and a tamper evident cap having a radially extending lower lip which is secured between the retaining ring and the flange member and is arranged to completely cover the closure plug thereby prevent access to the contents of the drum by way of the closure until the tamper-evident cap is removed.

One object of the present invention is to provide an improved plastic drum and two-inch straight pipe thread closure.

Related objects and advantages of the present invention will be apparent from the following description.

DESCRIPTION OF THE PREFERRED EMBODIMENT

Figure 1:
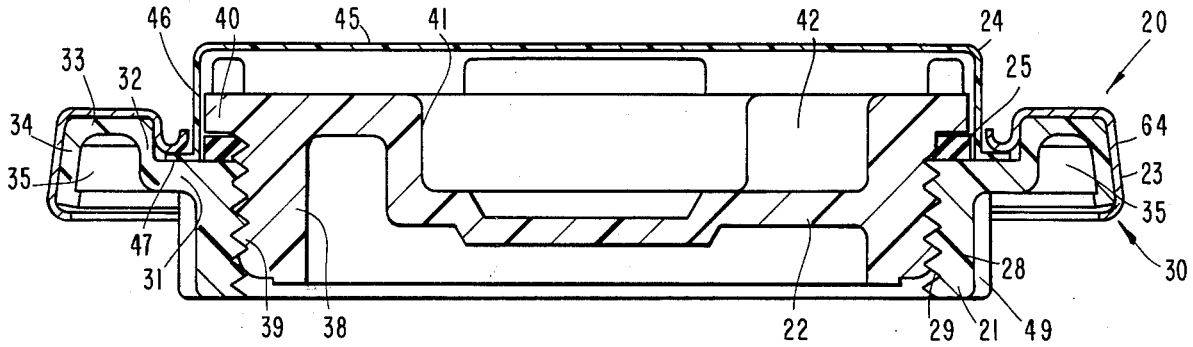
FIG. 1 is a side elevation view in full section of a closure assembly according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a closure assembly which includes plastic flange 21, closing plug 22, metal retaining ring 23, overseal 24 and gasket 25.

Plastic flange 21 includes a main body portion 28 which is generally cylindrical in appearance and includes a series of internal threads 29 which are designed and arranged as two-inch standard (straight) pipe threads. Flange 21 further includes an outwardly extending securing lip 30 which begins with radially-extending lower portion 31 which then turns upwardly into axially-extending inner wall 32 which then turns outwardly into radially-extending upper portion 33 which finally turns downwardly into axially-extending outer wall 34. The inner and outer wall in combination with upper portion 33 define a downwardly-opening annular channel 35. The upper surface of lower portion 31 is substantially flush with the upper surface of main body portion 28 and in combination therewith defines a substantially horizontal surface against which gasket 25 and overseal 24 abut.

Closing plug 22 includes a main body portion 38 which is externally threaded with two-inch standard (straight) pipe threads 39 and a radially-extending lip 40. The central portion of plug 22 includes a series of inwardly protruding splines 41 and alternating recesses 42, and in the exemplary embodiment, there are four splines and four recesses and these serve the purpose of providing a matching contour for manual wrenches as well as for automated equipment for installing and removing closing plug 22.

Overseal 24 is fabricated of a molded plastic member of unitary construction and is continuous throughout without having any perforations, score lines, tabs or other disruptions. The top surface 45 of overseal 24 is substantially parallel to the top surface of radially extending upper portion 33. The surrounding side wall 46 of the overseal is substantially normal with its top surface and radially extending from the lower edge of side wall 46 is lip 47. As sould be understood, the entire closure assembly 20 is annular in nature (see FIGS. 4 and 5) and as such virtually all components, portions and surfaces have an annular or annular ring appearance.

In this regard, gasket 25 is of an annular ring shape and is disposed directly beneath radially extending lip 40 of plug 22. As should be understood, as plug 22 is advanced into threaded engagement with plastic flange 21 by means of threads 29 and 39, gasket 25 is compressed, establishing a liquid-tight interface once the closing plug 22 is fully advanced. It is also to be understood that whether by manual use of a tightening wrench or similar implement, or whether by the use of automated equipment for tightening of the closing plug, substantial torque is imparted to the plug and in turn to plastic flange 21. In order to accept such torque for the purposes of establishing a liquid-tight interface while at the same time not distorting nor causing plastic flange 21 to rotate, plastic flange 21 includes an external series of splines 49 which are designed and arranged to be received between internal splines 50 which are disposed within the drum end neck finish (see FIG. 2). Each such external spline 49 extends radially outward from the outer surface of main body portion 28 the distance of approximately 1/16 of an inch. Circumferentially, each spline 49 extends approximately 0.46 inches and there is a total of eight splines disposed on the outer surface of main body portion 28. Alternating with each such spline 49 is a recessed area 49*a*, the inner surface of which comprises the outer surface of main body portion 28. Each of these recessed areas 49*a* has a circumferential length of approximately 0.53 inches.

As should be understood, the spline and recess configuration of the drum end neck finish is just the opposite of that existing on plastic flange 21. For the neck finish splines 50, each spline is approximately 0.53 inches in circumferential length and the corresponding recesses 50*a* are approximately 0.46 inches in circumferential length. Consequently, the splines of the plastic flange fit within the recesses of the neck finish and the splines of the neck finish fit within the recesses of the plastic flange. As should be understood, minor dimensional variations must be made so as to insure a suitable fit and interchangeability though any excess clearance is kept to a minimum so as to avoid possible movement of the plastic flange within the neck finish during installation and removal of closing plug 22.

Figure 2:
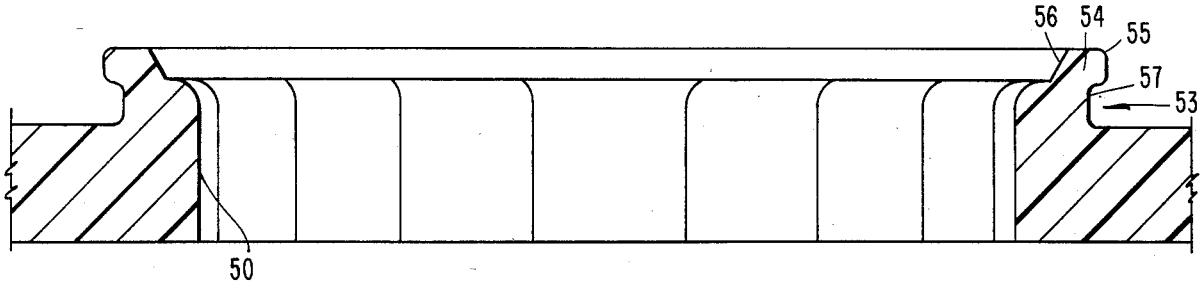
FIG. 2 is a side elevation view in full section of a drum end neck finish suitably designed in a manner to receive the FIG. 1 closure assembly.

Referring to FIG. 2, drum end neck finish 53 is illustrated and includes in addition to splines 50 and the alternating series of cooperating recesses 50*a*, a raised annular wall 54 which terminates into upper lip 55. The inner surface of lip 55 includes bevelled edge 56 and lip 55 radially extends outwardly from the outer surface of wall 54 so as to define an inner recess or channel 57.

Figure 4:
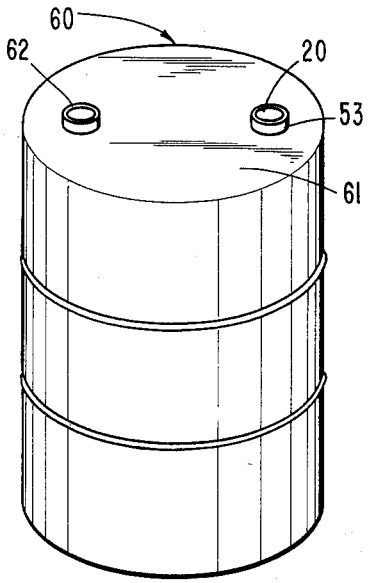
FIG. 4 is a perspective view of a plastic drum with the drum end including a buttress thread opening and a straight pipe thread opening according to a typical embodiment of the present invention.
Figure 5:
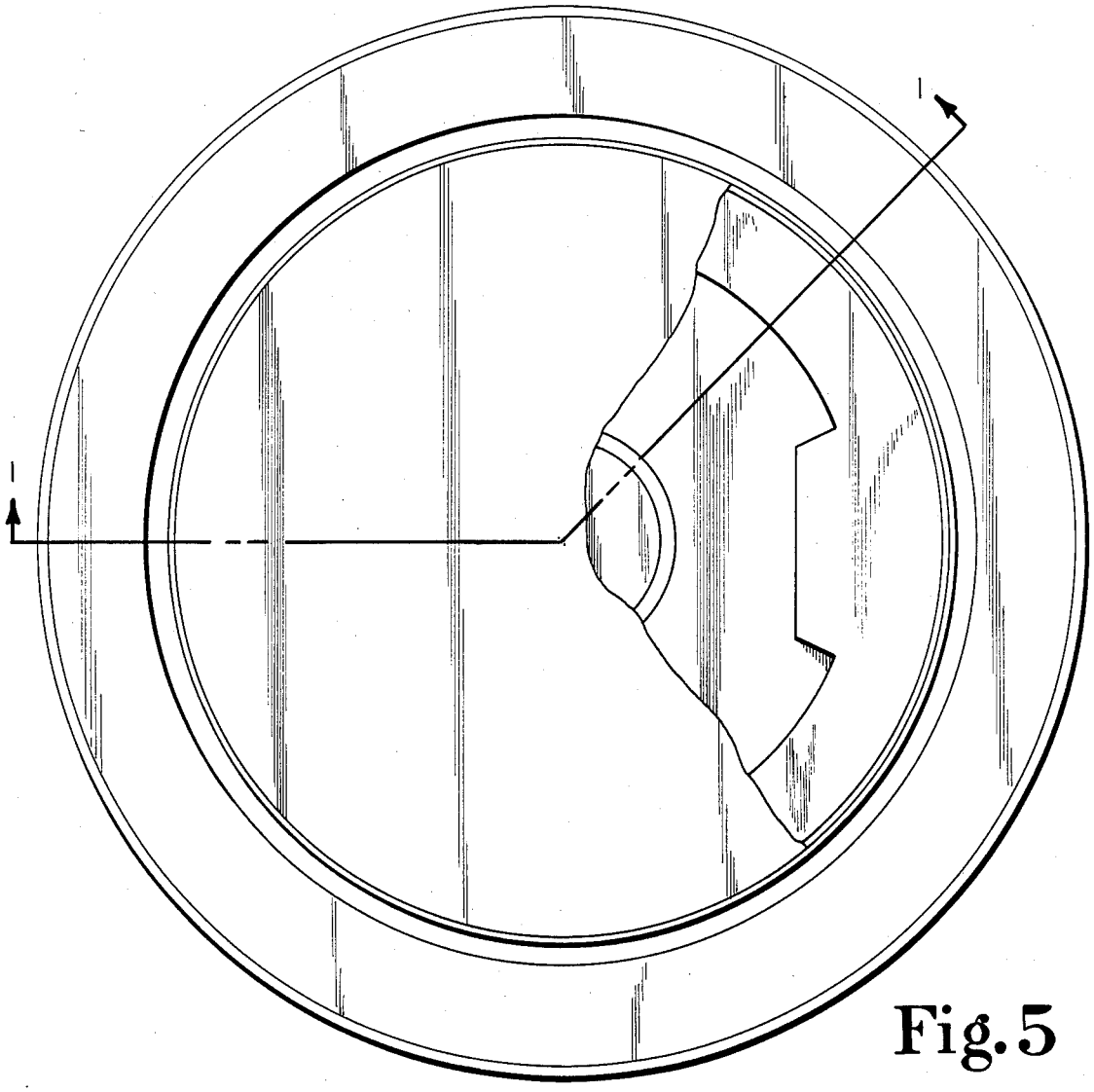
FIG. 5 is a top plan view of the FIG. 1 closure assembly.

As has been previously explained, closure 20 is designed and arranged to be received by a plastic drum. Such a drum 60 is illustrated in FIG. 4 and includes drum end 61 which is provided with a buttress thread opening 62 and neck finish 63 which receives closure assembly 20 as described above. The need for and desirability of the buttress thread opening as well as the two-inch standard (straight) pipe thread has been covered in the background discussion.

One advantage of utilizing plastic drums as opposed to steel or similar metal is the durability and opportunity for refilling and repetitive use. Consequently, although it may be well known to use plastic closures with metal drums, a plastic closure and plastic drum combination provides a unique set of circumstances, constraints and benefits. One such constraint is to configure the neck finish such that it has the requisite strength as well as contour so as to securely receive the closure and be capable of enabling a secure crimped assembly of the flange to the neck finish. With a plastic drum it is possible to mold the neck finish into a variety of unique shapes and contours and thereby specifically adapt the neck finish to the style of closure being assembled as well as to the assembly concept which is desired.

Figure 3:
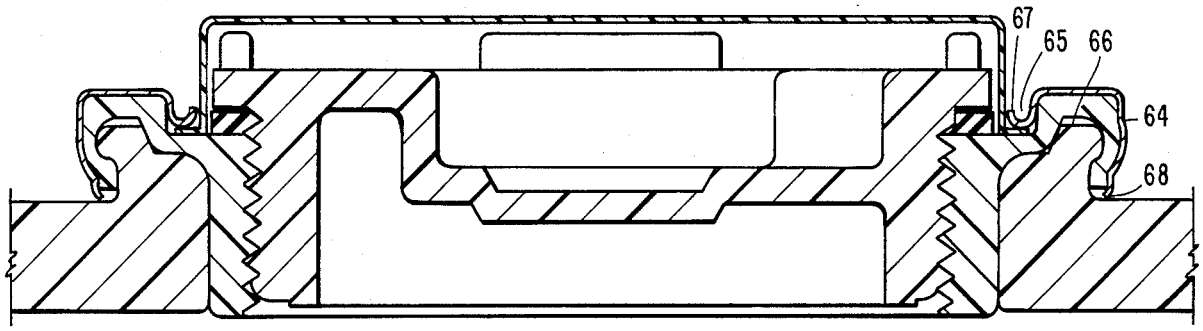
FIG. 3 is a side elevation view in full section of the FIG. 1 closure assembly as assembled onto and received by the FIG. 2 drum end neck finish according to a typical embodiment of the present invention.

Referring to FIG. 3, the role of metal retaining ring 23 is illustrated in greater detail. As could be seen from FIG. 1, retaining ring 23 begins with an inverted U-shape wherein its outer wall 64 flares out slightly and includes an under portion which curls slightly beneath the lowermost corner and edge of outer wall 34 of the plastic flange 21. Similarly, the outer wall flares slightly in an outward direction thereby enabling channel 35 to be wide open and fully capable of fitting over upper lip 55. As the two sets of splines 49 and 50 mutually engage with the corresponding alternating recesses 50*a* and 49*a*, channel 35 is moved into position over and around upper lip 55. Then, by means of a crimping instrument which fits into channel 65 on the inside surface of retaining ring 23 and applies radial force inwardly on outer wall 64, the outer wall 64 is deformed as it squeezes the thinner plastic of axially extending outer wall 34 against, around and beneath upper lip 55. Due to the fact that retaining ring 23 is designed so as to fit against both axially extending inner wall 32 and outer wall 34, back-up support is provided for the crimping operation such that the only portions of the closure assembly which respond to the inwardly directed radial forces are outer wall 64 and outer wall 34. These portions are allowed to move inwardly until they begin to contact the outer surface of lip 55 and channel 57. The continued application of the radially-inward crimping force creates a squeezing action and ultimately a tightly secured assembly. By the placement of a gasket compound 66 on the undersurface of radially-extending upper portion 33, any possible gap, unevenness or separation is filled thereby enhancing the reliability of the liquid-tight seal which is created by crimping of the retaining ring 23.

It should be noted that the innermost and upwardly projecting free edge 67 of the retaining ring remains exposed as does the opposite, downwardly extending free end 68. As mentioned in the background discussion of the present invention, if the internal two-inch straight pipe threads present as part of plastic flange 21 ever become damaged, it is possible to remove the retaining ring and thereafter lift the plastic flange up and off of the neck finish. Since the neck finish and its upper lip 55 are not altered nor distorted by the crimping operation of the retaining ring, the drum end neck finish remains unaltered and retains its initial contour. The neck finish is thus ready to accept a replacement closure assembly of a virtually identical construction to that initially assembled. In this manner, the plastic drum may be refilled, recycled and reused on many occasions and if at any point the plastic flange threads become unsuitable for continued use, the filler or reconditioner merely pulls off the retaining ring, lifts off the plastic flange from the neck finish and crimps on a new plastic flange.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a synthetic material drum having a drum end molded with at least one internally splined, raised annular boss; and a pipe thread closure comprising:

an externally splined flange member of synthetic material and unitary construction and having internal threading and an outwardly-radiating lip defining a downwardly opening annular channel suitably designed and arranged to receive said raised annular boss;

an annular metal retaining ring defining a downwardly opening annular channel shaped to conform to the outer surface of said outwardly-radiating lip and overlying and engaging said lip above, inwardly and outwardly of said raised annular boss;

a unitary, synthetic material closure plug having a series of external threads which are designed and arranged for engagement with said internal threading.

2. The combination of claim 1 wherein a tamper-evident cap having a radially-extending lower lip which is secured between said retaining ring and said flange member and is arranged to completely cover said closure plug thereby preventing access to the contents of said drum by way of said closure until said tamper-evident cap is removed.

3. The combination of claim 2 wherein said closure plug further includes wrench splines for advancing and removing said plug.

4. The combination of claim 1 wherein said raised annular boss includes an outwardly-extending annular lip.

5. In combination:

a synthetic material drum having a drum end molded with at least one internally splined, raised annular boss; and a pipe thread closure comprising:

an externally splined flange member of synthetic material and unitary construction and having internal threading and an outwardly-radiating lip defining a downwardly opening annular channel suitably designed and arranged to receive said raised annular boss;

an annular metal retaining ring defining a downwardly opening annular channel shaped to conform to the outer surface of said outwardly-radiating lip and overlying and engaging said lip above, inwardly and outwardly of said raised annular boss;

a unitary, synthetic material closure plug having a series of external threads which are designed and arranged for engagement with said internal threading; and a tamper-evident cap having a radially-extending lower lip which is secured between said retaining ring and said flange member and is arranged to completely cover said closure plug thereby preventing access to the contents of said drum by way of said closure until said tamper-evident cap is removed.

6. The combination of claim 5 wherein said closure plug further includes wrench splines for advancing and removing said plug.

7. The combination of claim 5 wherein said raised annular boss includes an outwardly-extending annular lip.

8. The combination of claim 7 wherein said outwardly-radiating lip defines a downwardly opening channel which receives said annular lip.

9. A closure assembly for use in combination with a synthetic material drum which has a drum end molded with at least one internally splined, raised annular boss, said closure assembly comprising:

an externally splined flange member of synthetic material and unitary construction and having internal threading and an outwardly-radiating lip defining a downwardly opening annular channel suitably designed and arranged to receive said raised annular boss;

an annular metal retaining ring defining a downwardly opening annular channel shaped to conform to the outer surface of said outwardly-radiating lip and overlying and engaging said lip above, inwardly and outwardly of said raised annular boss; and a unitary, synthetic material closure plug having a series of external threads which are designed and arranged for engagement with said internal threading.

10. The closure assembly of claim 9 wherein a tamper-evident cap having a radially-extending lower lip which is secured between said retaining ring and said flange member and is arranged to completely cover said closure plug thereby preventing access to the contents of said drum by way of said closure until said tamper-evident cap is removed.

11. The closure assembly of claim 9 wherein said closure plug further includes wrench splines for advancing and removing said plug.

* * * * *